US006034706A

United States Patent [19]

Nagahata

[11] Patent Number: 6,034,706

[45] Date of Patent: Mar. 7, 2000

[54] HEAD DEVICE PROVIDED WITH DRIVE ICS, TO WHICH PROTECTIVE COATING IS APPLIED, AND METHOD OF FORMING PROTECTIVE COATING

[75] Inventor: Takaya Nagahata, Kyoto, Japan

[73] Assignee: Rohm Co., Ltd., Kyoto, Japan

[21] Appl. No.: 08/973,201

[22] PCT Filed: May 29, 1997

[86] PCT No.: PCT/JP97/01864

§ 371 Date: Dec. 16, 1997

§ 102(e) Date: Dec. 16, 1997

[87] PCT Pub. No.: WO97/45270

PCT Pub. Date: Dec. 4, 1997

[30] Foreign Application Priority Data

May 30, 1996 [JP] Japan ..... 8-136336

[51] Int. Cl.[7] ..... B41J 2/335; B41J 2/34

[52] U.S. Cl. ..... 347/200

[58] Field of Search ..... 347/200, 209, 347/210

[56] References Cited

U.S. PATENT DOCUMENTS 4,689,638 8/1987 Matsuzaki et al. ..... 347/209
5,157,414 10/1992 Seino et al. .
5,485,192 1/1996 Nagahata et al. .

FOREIGN PATENT DOCUMENTS 0 342 243 11/1989 European Pat. Off. .
0 513 660 11/1992 European Pat. Off. .
0 562 433 9/1993 European Pat. Off. .
3-57656 3/1991 Japan .
8-132451 3/1996 Japan .
WO 96/11109 4/1996 WIPO .

*Primary Examiner*—Huan Tran
*Attorney, Agent, or Firm*—Merchant & Gould P.C.

[57] ABSTRACT

A head device (10), in particular a thermal printhead, is provided which includes an insulating substrate (11) having a first longitudinal edge (11*a*) and a second longitudinal edge (11*b*) opposite to the first longitudinal edge (11*a*), an operating element (12) arranged on the substrate adjacent to the first longitudinal edge (11*a*), an array of plural drive ICs (13) arranged on the substrate (11) along the second longitudinal edge (11*b*) for actuating the operating element (12), and a protective resin coating (17) for enclosing the drive ICs (13). The protective coating (17) includes a terminal protrusion (17*a*) which is made at the time of forming the protective coating (17) by resin application. The terminal protrusion (17*a*) is located between two adjacent drive ICs (13) and projects toward the second edge (11*b*) of the substrate (11).

17 Claims, 9 Drawing Sheets

HEAD DEVICE PROVIDED WITH DRIVE ICS, TO WHICH PROTECTIVE COATING IS APPLIED, AND METHOD OF FORMING PROTECTIVE COATING

TECHNICAL FIELD

The present invention relates to a head device, such as a thermal printhead, which incorporates drive ICs enclosed by a protective coating. The present invention also relates to a method of forming such a protective coating.

BACKGROUND ART

Typically, a conventional thick-film type thermal printhead has an arrangement shown in FIGS. 9–13. Specifically, the thermal printhead generally indicated by reference numeral 10" includes a heat sink plate 20". The heat sink plate is made of a metal material having high thermal conductivity like aluminum. The printhead also includes an elongated rectangular head substrate 11" carried by the heat sink plate 20". The substrate is made of an insulating material such as alumina ceramic.

The head substrate 11" includes a first longitudinal edge 11*a*" and a second longitudinal edge 11*b*" opposite to the first longitudinal edge 11*a*". The head substrate 11" has an upper surface formed with a linear heating resistor 12" extending along the first longitudinal edge 11*a*". The upper surface is also formed with an array of plural drive ICs 13" arranged along the second longitudinal edge 11*b*" for actuating the heating resistor 12".

As shown in FIG. 10, the upper surface of the head substrate 11" is formed with a common electrode 14" having comb-like teeth 14*a*" adjacent to the heating resistor 12". The teeth 14*a*" extend beneath the heating resistor 12". Further, individual electrodes 15" are provided in an alternating manner relative to the teeth 14*a*" of the common electrode 14". The individual electrodes 15" also extend beneath the heating resistor 12". The heating resistor 12" is divided into portions defined by adjacent teeth 14*a*" of the common electrode 14". Each portion (see the shaded area in FIG. 10) operates as a heating dot 16". When voltage is selectively applied on the individual electrodes 15" via the drive ICs 13", relevant heating dots 16" will be actuated for heating.

As shown in FIG. 12, each individual electrode 15" extends toward the second longitudinal edge 11*b*" of the head substrate 11" to be connected to the output side of a corresponding drive IC 13" via a bonding wire 21*a*". The input side of each drive IC 13" is connected via a bonding wire 21*b*" to a wiring pattern 22" formed on the head substrate 11". The bonding wires 21*a*", 21*b*" together with the drive ICs 13" are enclosed by a protective coating 17" made of an epoxy resin.

The conventional protective coating 17" is formed in the following manner. While being shifted, a dispenser having a projection nozzle supplies a viscid but fluid epoxy resin to enclose the drive ICs 13" and the bonding wires 21*a*", 21*b*". Then, the substrate 11" is brought into a heating furnace to cure the above epoxy resin.

In the field of thermal printheads of the type described above, efforts have been made to minimize the size of the thermal printheads. More specifically, the longitudinal length of the head substrate 11" is inevitably adapted to a desired printing span. Thus, efforts have been made to minimize the widthwise dimension of the head substrate 11". Accordingly, the protective coating 17" needs to be properly formed within a limited region as viewed widthwise of the substrate. To this end, the epoxy resin to be utilized is selected from resins which have comparatively high viscosities when supplied from the dispenser. This is because an epoxy resin of a low viscosity would disadvantageously flow onto unintended regions in its application.

In utilizing an epoxy resin material having high viscosity, the application of the resin material needs be performed along a spiral path as shown in FIG. 11. Specifically, starting from a point adjacent to one end of the array of the drive ICs 13", the resin application is first performed for the bonding wires 21*a*" which connect the drive ICs 13" and the individual electrodes 15" (see also FIG. 12). Then, turning at the opposite end of the array of the drive ICs 13", the resin application is performed for the bonding wires 21*b*" which connect the drive ICs 13" and the wiring pattern 22". Further, turning at the first-mentioned end of the array of the drive ICs 13" while also being shifted inward, the resin application is performed for the drive ICs 13". At this time, the applied resin is arranged to extend over the array of the drive ICs 13" longitudinally thereof. Resin application is performed in the above-described spiral manner. This is because, if the application of the resin material for the mounting region of the drive ICs 13" is performed only once along a single straight line, the predetermined area needed to be applied by the resin material will not be entirely covered by the resin material due to the comparatively high viscosity of the epoxy resin. Further, the spiral application path is preferable for causing the resulting protective coating 17" to have a suitable cross section.

As shown in FIG. 11, the resin application path begins at one end of the array of the drive ICs 13" and terminates at the opposite end thereof. Further, as shown in FIG. 13, a horn-like protrusion 17*a*" may be formed at the terminal end of the resin application path. This is because the applied epoxy resin has the rather high viscosity and, at the terminal end of the application path, the projection nozzle of the dispenser is being shifted upward after the resin supply is stopped. Then, the protrusion 17*a*" will be cured with the horn shape maintained.

Thus formed protrusion 17*a*" of the protective coating 17" may unfavorably damage a recording medium such as recording paper or deteriorate prints formed thereon through contact with the recording medium. Such inconvenience will become more critical to the latest model of e.g. printing device, in which the feeding path of recording paper is disposed as close to the surface of the thermal printhead as possible for purposes of miniaturization for example.

DISCLOSURE OF THE INVENTION

Therefore, it is an object of the present invention to provide a head device or a thermal printhead in particular which is capable of overcoming or relieving the above problem.

It is another object of the present invention to provide a method of forming a protective coating suitable for enclosing drive ICs mounted on a head device or a thermal printhead in particular.

According to a first aspect of the present invention, a head device is provided which includes: an insulating substrate having a first longitudinal edge and a second longitudinal edge opposite to the first longitudinal edge; an operating element arranged on the substrate adjacent to the first longitudinal edge; an array of plural drive ICs arranged on the substrate along the second longitudinal edge for actuating the operating element; and a protective resin coating for enclosing the drive ICs. The protective coating includes a terminal protrusion which is made at the time of forming the protective coating by resin application. The head device is characterized by the terminal protrusion which projects toward the second edge of the substrate.

The advantages of the head device having the above arrangement will be described hereinafter in connection with the embodiments illustrated in the accompanying drawings.

In a preferred embodiment of the present invention, the terminal protrusion projects downward toward the second edge of the substrate. When the drive ICs are spaced from each other, the terminal protrusion is preferably positioned between a pair of adjacent drive ICs.

The protective coating may be made of a heat-resisting resin. The heat-resisting resin may be a thermosetting resin such as epoxy resin for example, or a soft resin such as silicone resin for example.

A typical head device to which the present invention is applicable is a thermal printhead, in which the operating element is a heating resistor.

According to a second aspect of the present invention, a head device is provided which includes: an insulating substrate having a first longitudinal edge and a second longitudinal edge opposite to the first longitudinal edge; an operating element arranged on the substrate adjacent to the first longitudinal edge; an array of plural drive ICs mounted on the substrate and spaced from each other along the second longitudinal edge for actuating the operating element; and a protective resin coating for enclosing the drive ICs. The protective coating includes a terminal protrusion which is made at the time of forming the protective coating by resin application. The present invention is characterized by the terminal protrusion which is positioned between a pair of adjacent drive ICs.

According to a third aspect of the present invention, there is provided a method for forming a protective resin coating for a head device including an insulating substrate having a first longitudinal edge and a second longitudinal edge opposite to the first longitudinal edge, an operating element arranged on the substrate adjacent to the first longitudinal edge, and an array of plural drive ICs arranged on the substrate along the second longitudinal edge for actuating the operating element. The protective coating is used for enclosing the drive ICs. The method is characterized by the steps of applying a fluid resin from a projection nozzle along an elongated spiral path for enclosing the drive ICs; and stopping the resin application while the projection nozzle is being moved toward the second longitudinal edge of the substrate.

In the above method, the resin application is advantageously stopped while the projection nozzle is being moved downward toward the second longitudinal edge of the substrate.

According to a fourth aspect of the present invention, there is provided a method of forming a protective resin coating for a head device including an insulating substrate having a first longitudinal edge and a second longitudinal edge opposite to the first longitudinal edge, an operating element arranged on the substrate adjacent to the first longitudinal edge, and an array of plural drive ICs mounted on the substrate and spaced from each other along the second longitudinal edge for actuating the operating element. The protective coating is used for enclosing the drive ICs. The method is characterized by the steps of: applying a fluid resin from a projection nozzle along an elongated spiral path for enclosing the drive ICs; and stopping the resin application at a position between a pair of adjacent drive ICs.

Other features and advantages of the present invention will become clearer from preferred embodiments described below with reference to the accompanying drawings.

BEST MODE FOR CARRYING OUT THE INVENTION

The present invention will be described below in connection with embodiments of a thermal printhead by referring to FIGS. 1–8. It should be noted, however, that the present invention is not limited to thermal printheads.

Figure 1:
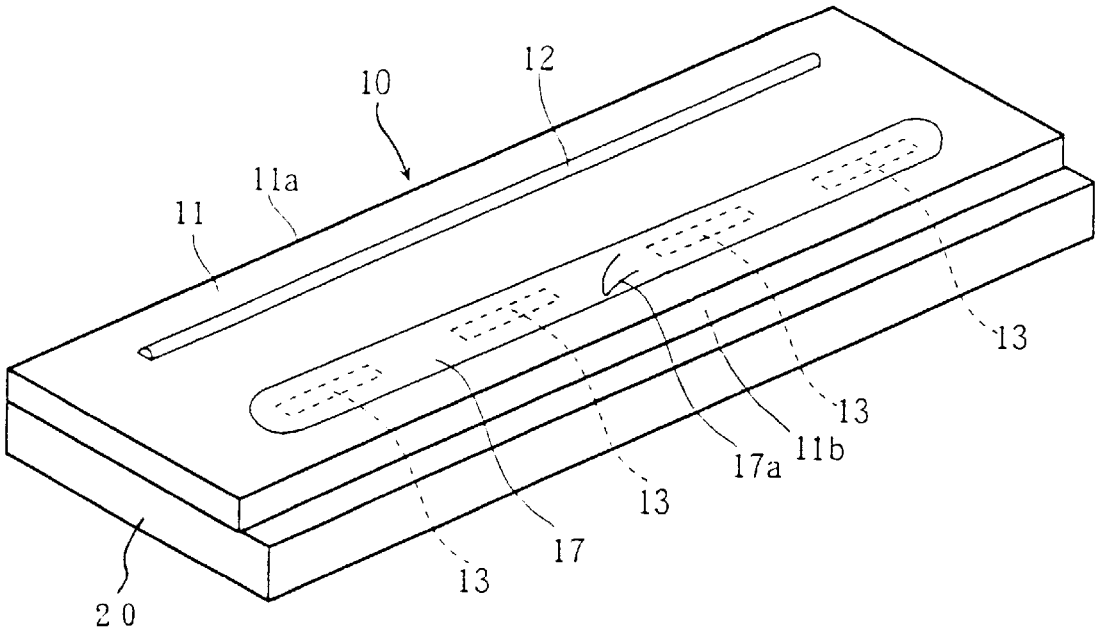
FIG. 1 is an overall perspective view showing a thermal printhead according to the present invention.

As shown in FIG. 1, a thermal printhead 10 embodying the present invention has a basic arrangement typical of the so-called thick-film type thermal printhead. The thermal printhead 10 includes a heat sink plate 20 made of a metal having high thermal conductivity like aluminum. The printhead also includes an elongated rectangular head substrate 11 made of an insulating material such as alumina ceramic. The head substrate is mounted on the heat sink plate 20.

The head substrate 11 includes a first longitudinal edge 11*a* and a second longitudinal edge 11*b* opposite to the first longitudinal edge 11*a*. The head substrate 11 has an upper surface provided with a heating resistor 12 extending along the first longitudinal edge 11*a*. The upper surface is also provided with an array of plural drive ICs 13 arranged along the second longitudinal edge 11*b* for actuating the heating resistor 12. The heating resistor 12, which may be made of a resistive paste of e.g. ruthenium oxide, is formed into a line shape by a thick-film printing method.

Figure 2:
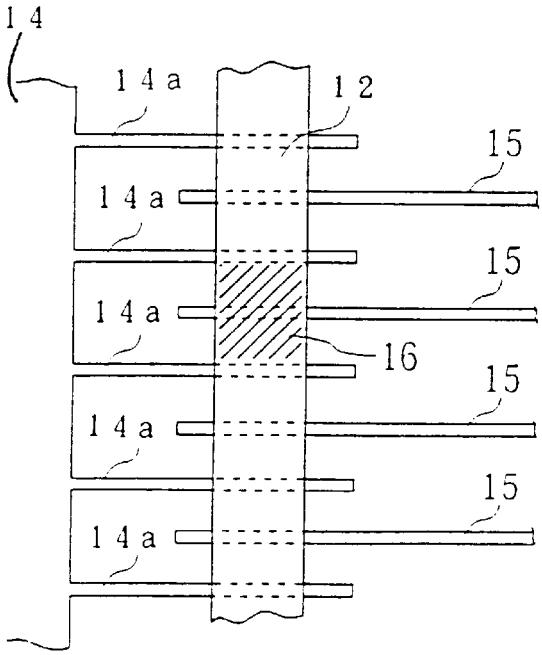
FIG. 2 is a plan view showing the heating resistor of the same thermal printhead together with related elements.

As shown in FIG. 2, the upper surface of the head substrate 11 is formed with a common electrode 14 adjacent to the heating resistor 12. The common electrode includes comb-like teeth 14*a* extending under the heating resistor 12. Further, there are provided individual electrodes 15 arranged in an alternating manner relative to the teeth 14*a* of the common electrode 14. The individual electrodes 15 also extend under the heating resistor 12. The heating resistor 12 is divided into regions each of which is defined by adjacent teeth 14*a* of the common electrode 14 (see the shaded portion in FIG. 2). The above regions operate as heating dots 16. When voltage is selectively applied on the individual electrodes 15 via the drive ICs 13, relevant heating dots 16 are actuated for heating.

Figure 4:
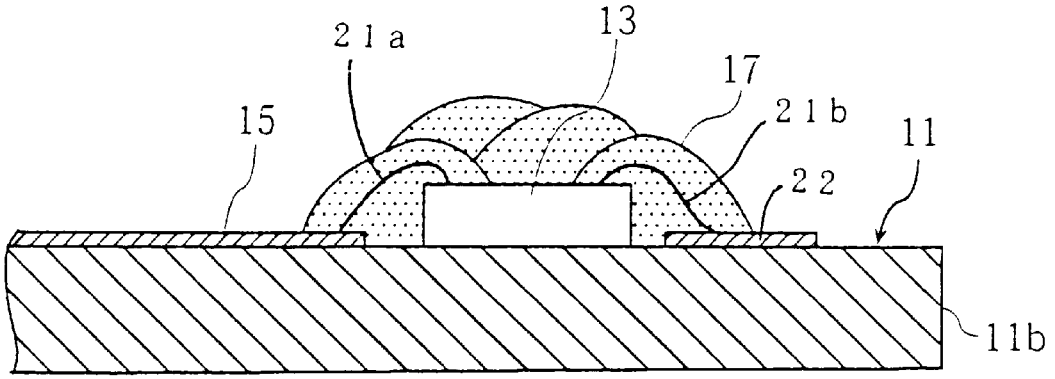
FIG. 4 is a sectional view along lines IV—IV in FIG. 3.

As shown in FIG. 4, each individual electrode 15 extends toward the second-longitudinal edge 11*b* of the head substrate 11. The individual electrode is connected to the output side of a corresponding drive IC 13 via a bonding wire 21*a*. Likewise, by means of a bonding wire 21*b*, the input side of the drive IC 13 is connected to a wiring pattern 22 (only schematically shown in FIG. 4) formed on the head substrate 11.

The teeth 14*a* of the common electrode 14 are formed at intervals of 125 $\mu$m when a printing density of 200 dpi is desired. Correspondingly, the individual electrodes are formed at the same intervals. Minute wiring patterns on the insulating substrate, including the common electrode 14 and the individual electrodes 15, may be formed by minutely etching a conductive film made of e.g. gold provided on the substrate.

The drive ICs 13 on the head substrate 11, together with the bonding wires 21*a*, 21*b* connected to the drive ICs, are enclosed by a protective resin coating 17. The areas other than the above regions enclosed by the protective coating 17 may typically be covered by a protective layer (not shown) made of glass for example. The protective coating 17 is preferably made of a heat-resisting resin. In such an instance, use is made to a thermosetting resin such as epoxy resin and phenol resin, or to a soft resin such as silicone resin.

The protective coating 17 is made in the following manner. A resin material (such as epoxy resin for example) initially existing in a fluid state is applied to the area in which the drive ICs 13 and the bonding wires 21*a*, 21*b* are provided. The fluid resin material is supplied from a projection nozzle 18 (FIG. 5) as a resin dispenser while the projection nozzle is being shifted. Then, the substrate 11 is brought into a heating furnace to cure the resin material. The present invention is characterized by the method of forming the protective coating 17 and by the form of the protective coating 17 made by the above method.

Figure 3:
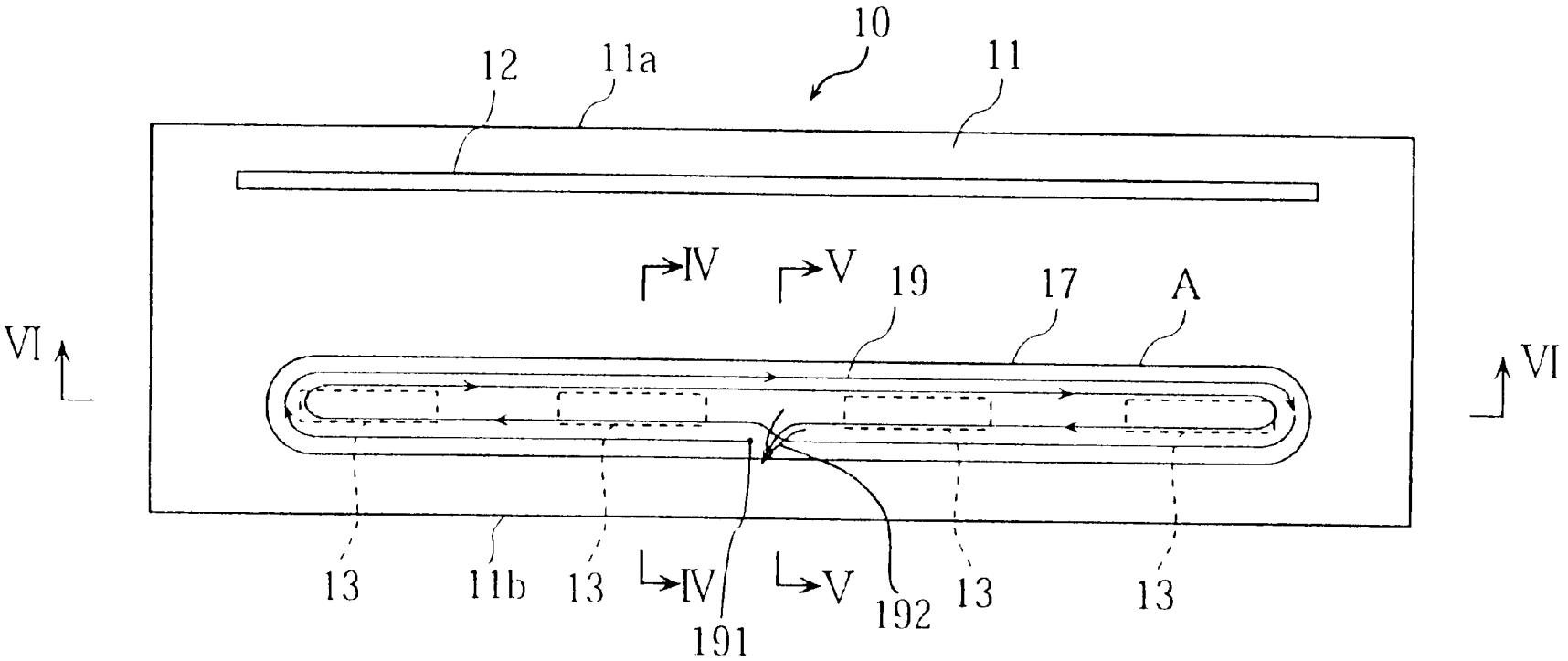
FIG. 3 is a plan view illustrating the first embodiment of a method for forming a protective coating for the same thermal printhead.

FIG. 3 shows a first embodiment of the method for forming the protective coating 17. In the figure, the moving path 19 of the projection nozzle 18 as seen from above is shown. The moving path 19 of the projection nozzle 18 has a starting point 191 located within the region A allotted for formation of the protective coating 17. The starting point is disposed in a longitudinally central portion of the region A and closer to the second longitudinal edge 11*b* of the head substrate 11. Starting from the point 191, the moving path 19 winds twice inwardly in an elongated spiral manner. The moving path 19 terminates near the starting point 191, with its end portion (terminal end 192) projecting toward the second longitudinal edge 11*b* of the head substrate 11. It should be noted that both the starting point 191 and the terminal end 192 of the resin application are located between two adjacent drive ICs 13.

Figure 5:
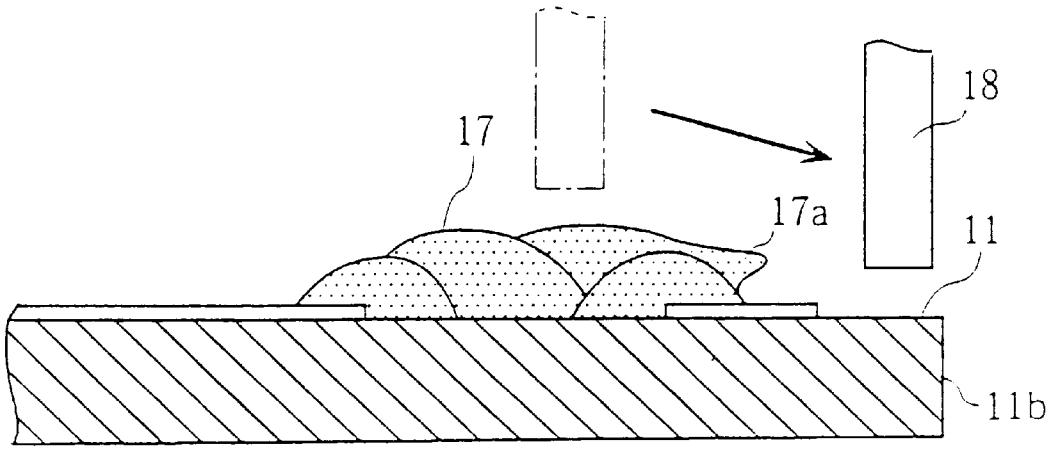
FIG. 5 is a sectional view along lines V—V in FIG. 3.

The terminal end 192 of the resin application is formed by moving the projection nozzle 18 toward the second longitudinal edge 11*b* of the head substrate 11 while the resin supply is being stopped. In this operation, the projection nozzle 18 is preferably moved downward toward the second longitudinal edge 11*b* of the head substrate 11, as shown in FIG. 5, to complete the resin application.

The epoxy resin is a material having predetermined viscosity. Thus, even after the resin supply from the projection nozzle 18 is stopped, a whisker-like or horn-like protrusion 17*a* will be formed at the terminal end 192. However, according to the resin application method described above, the terminal end 192 of the resin application is directed toward the second longitudinal edge 11*b* of the head substrate 11. Thus, even if the above-mentioned whisker-like or horn-like protrusion 17*a* is formed, the distance between the heating resistor 12 and the protrusion is rendered maximized. As a result, it is possible, to a great extent, to advantageously prevent recording paper (not shown) or printed letters on the recording paper from being damaged by the protrusion 17*a* which would otherwise contact them.

Figure 6:
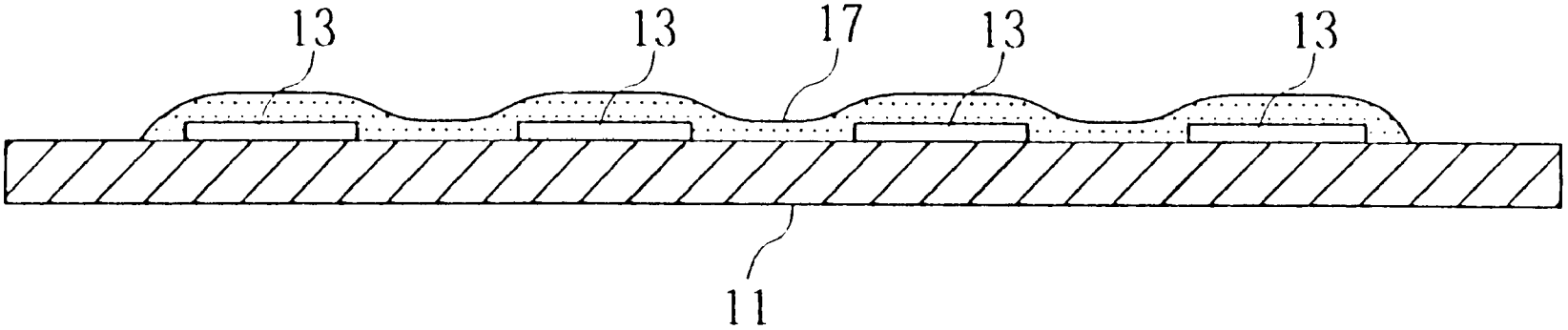
FIG. 6 is a sectional view along lines VI—VI in FIG. 3.

The above advantage is enjoyed more effectively by arranging the terminal end 192 of the resin application between two adjacent drive ICs 13. Specifically, as shown in FIG. 6, the surface of the protective coating 17 is lower at portions with no drive ICs 13 provided than at the other portions where the drive ICs 13 are provided. As a result, the protrusion 17*a* is prevented from projecting upward beyond the surface level of the protective coating 17 where the drive ICs 13 are enclosed.

Further, as previously described, the terminal end 192 of the resin application is formed while the projection nozzle 18 is being shifted slightly downward. Consequently, as shown in FIG. 5, the whisker-like or horn-like protrusion 17*a* is directed downward relative to the horizontal direction. Thus, the protrusion is much less likely to contact recording paper.

Figure 7:
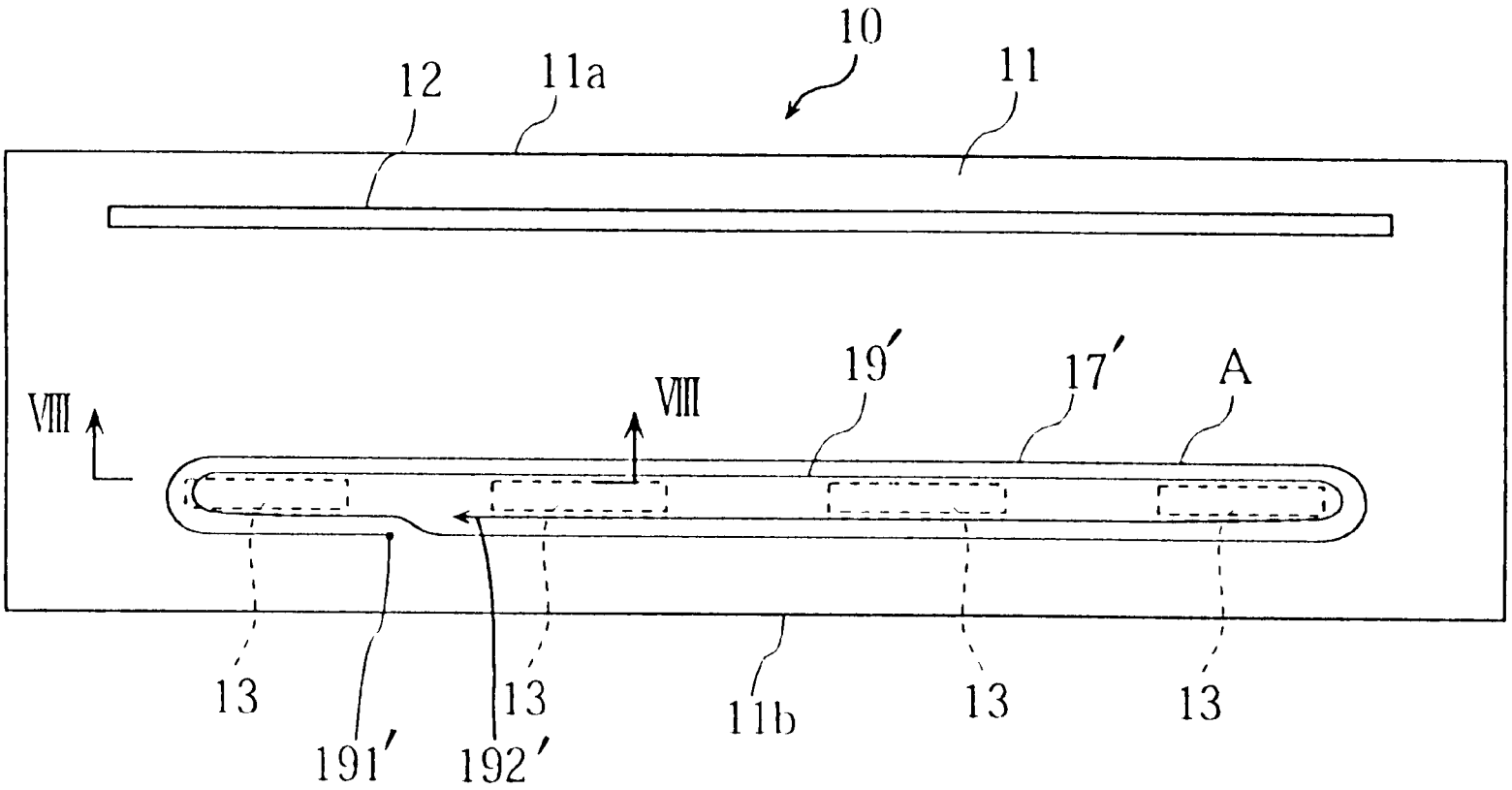
FIG. 7 is a plan view illustrating the second embodiment of a method for forming a protective coating.
Figure 8:
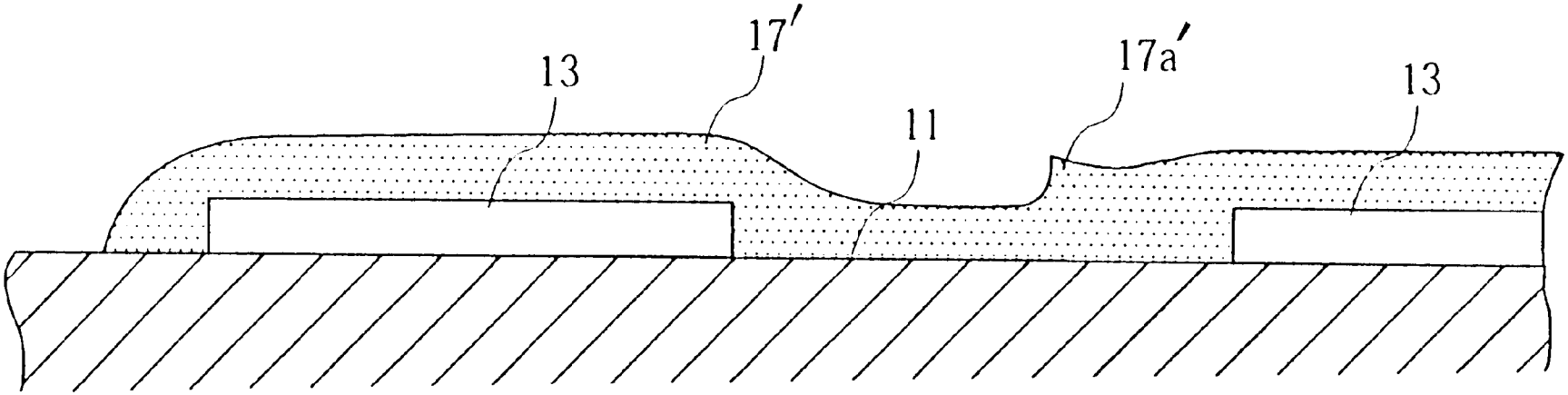
FIG. 8 is a sectional view taken along lines VIII—VIII in FIG. 7.
Figure 9:
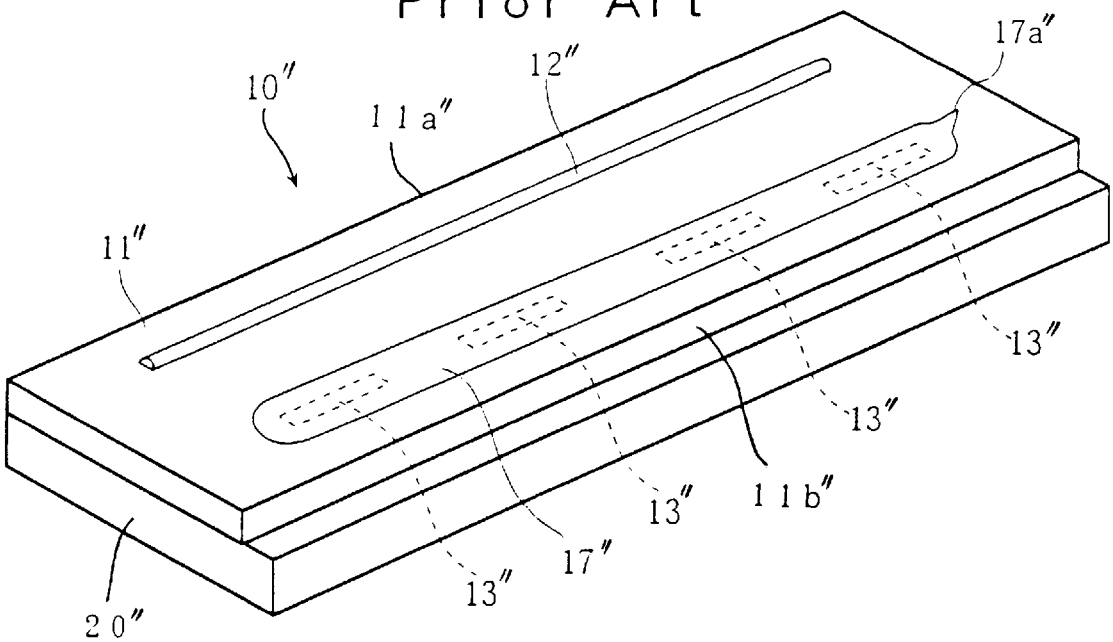
FIG. 9 Prior Art
FIG. 9 is an overall perspective view showing a prior art thermal printhead.
Figure 10:
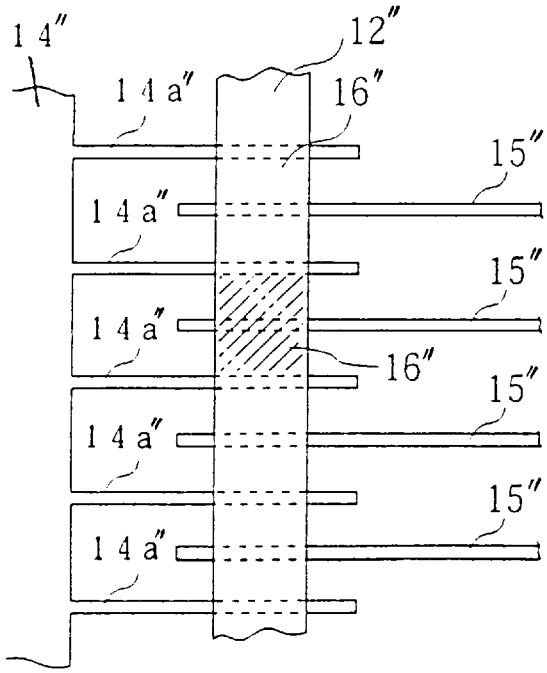
FIG. 10 Prior Art
FIG. 10 is a plan view showing the heating resistor of the same prior art thermal printhead together with related elements.
Figure 11:
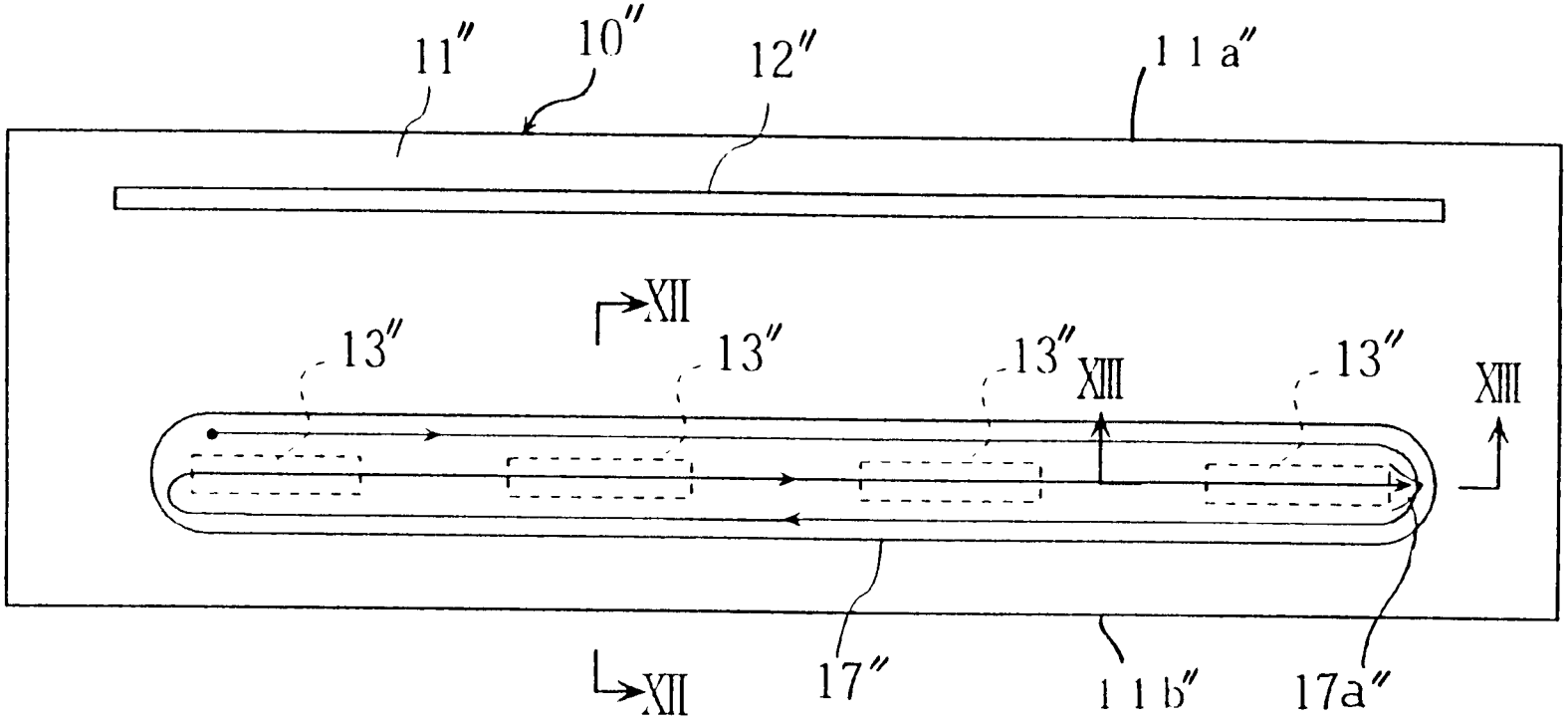
FIG. 11 Prior Art
FIG. 11 is a plan view illustrating a method for forming a protective coating for the same prior art thermal printhead.
Figure 12:
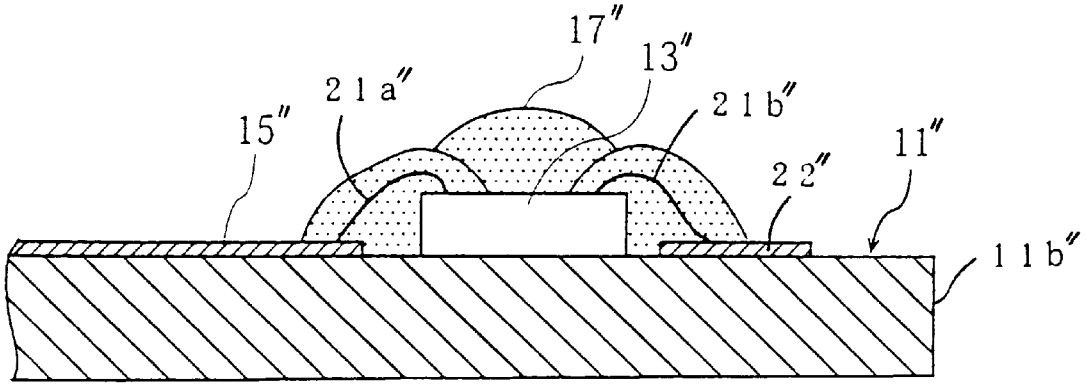
FIG. 12 Prior Art
FIG. 12 is a sectional view taken along lines XII—XII in FIG. 3.
Figure 13:
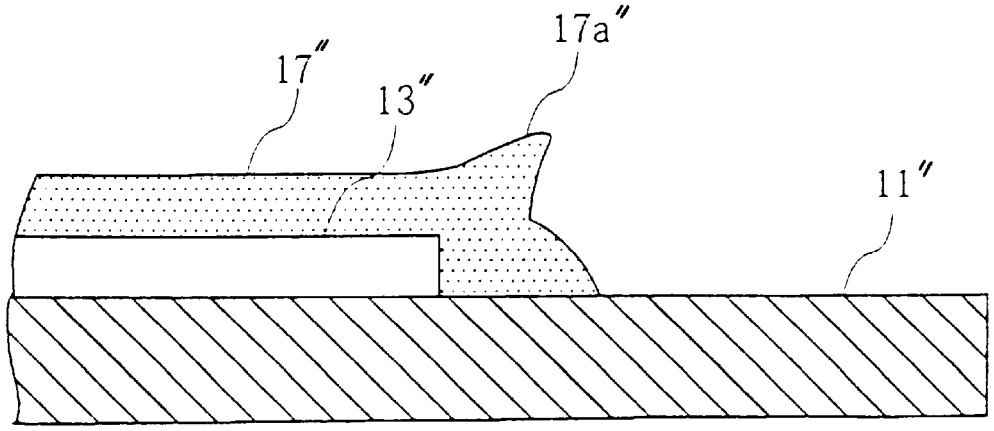
FIG. 13 Prior Art
FIG. 13 is a sectional view taken along lines XIII—XIII in FIG. 11.

FIG. 7 shows the second embodiment of a method of forming the protective coating 17. In the figure, another moving path 19 of the projection nozzle 18 as viewed above is shown. In FIG. 7, the same elements as those shown in FIG. 3 are indicated by the same reference numerals, whereas similar elements are indicated by the same numerals followed by a prime (').

In the second embodiment, the starting point 191' of the moving path 19' of the projection nozzle 18 (see FIG. 5) is arranged offset toward an end portion of the region A allotted for formation of the protective coating 17' from the longitudinally central portion of the region A. Starting from the point 191', the moving path 19' winds twice inwardly in an elongated spiral manner, and terminates (at a terminal end 192') near the starting point 191'. Similarly to the resin application method according to the first embodiment, both the starting point 191' and the terminal end 192' of the resin application are disposed between two adjacent drive ICs 13. However, in forming the terminal end 192', the projection nozzle 18 is not shifted toward the second longitudinal edge 11*b* of the head substrate 11 nor downward.

As previously described, the surface of the protective coating 17' is lower at portions with no drive ICs 13 provided than at the portions with the drive ICs 13 provided. Further, in the second embodiment again, the terminal end 192' of the resin application is arranged between two adjacent drive ICs 13. Thus, the protrusion 17*a'* at the terminal end 192' is much less likely to project upwardly beyond the higher portions of the surface of the protective coating 17 with the drive ICs 13 provided. As a result, it is possible to eliminate or reduce damage to recording paper or deterioration of printed letters on the recording paper, which would otherwise be caused by the contacting of the protrusion 17*a'*.

The preferred embodiments of the present invention being thus described, the present invention is not limited to these embodiments. For instance, the present invention is also applicable to the so-called thin-film type thermal printhead other than the thick-film type thermal printhead. Further, the present invention is applicable to not only printheads but also other devices such as an image scanner head incorporating plural drive ICs which are mounted on an insulating substrate and enclosed by a protective coating.

I claim:

1. A head device comprising: an insulating substrate including a first longitudinal edge and a second longitudinal edge opposite to the first longitudinal edge; an operating element arranged on the substrate adjacent to the first longitudinal edge; an array of plural drive ICs arranged on the substrate along the second longitudinal edge for actuating the operating element; and a protective resin coating for enclosing the drive ICs, the protective coating including a terminal protrusion which is made at a time of forming the protective coating by resin application;

wherein the terminal protrusion projects toward the second longitudinal edge of the substrate along which the array of plural drive ICs are arranged.

2. A head device comprising: an insulating substrate including a first longitudinal edge and a second longitudinal edge opposite to the first longitudinal edge; an operating element arranged on the substrate adjacent to the first longitudinal edge; an array of plural drive ICs arranged on the substrate along the second longitudinal edge for actuating the operating element; and a protective resin coating for enclosing the drive ICs, the protective coating including a terminal protrusion which is made at a time of forming the protective coating by resin application;

wherein the terminal protrusion projects downward toward the second edge of the substrate.

3. The head device according to claim 1, wherein the drive ICs are spaced from each other, the terminal protrusion being positioned between a pair of adjacent drive ICs.

4. The head device according to claim 1, wherein the protective coating is made of a heat-resisting resin.

5. The head device according to claim 4, wherein the heat-resisting resin is a thermosetting resin.

6. The head device according to claim 5, wherein the thermosetting resin is an epoxy resin.

7. The head device according to claim 4, wherein the heat-resisting resin is a silicone resin.

8. A thermal printhead as the head device according to claim 1, wherein the operating element is a heating resistor.

9. A head device comprising: an insulating substrate including a first longitudinal edge and a second longitudinal edge opposite to the first longitudinal edge; an operating element arranged on the substrate adjacent to the first longitudinal edge; an array of plural drive ICs mounted on the substrate and spaced from each other along the second longitudinal edge for actuating the operating element; and a protective resin coating for enclosing the drive ICs, the protective coating including a terminal protrusion which is made at a time of forming the protective coating by resin application;

wherein the terminal protrusion is positioned between a pair of adjacent drive ICs.

10. The head device according to claim 9, wherein the protective coating is made of a heat-resisting resin.

11. The head device according to claim 10, wherein the heat-resisting resin is a thermosetting resin.

12. The head device according to claim 11, wherein the thermosetting resin is an epoxy resin.

13. The head device according to claim 10, wherein the heat-resisting resin is a silicone resin.

14. A thermal printhead as the head device according to claim 9, wherein the operating element is a heating resistor.

15. A method of forming a protective resin coating for a head device which includes an insulating substrate having a first longitudinal edge and a second longitudinal edge opposite to the first longitudinal edge, an operating element arranged on the substrate adjacent to the first longitudinal edge, and an array of plural drive ICs arranged on the substrate along the second longitudinal edge for actuating the operating element, the protective coating enclosing the drive ICs, the method comprising:

applying a fluid resin from a projection nozzle along an elongated spiral path for enclosing the drive ICs; and stopping the resin application while the projection nozzle is being moved toward the second longitudinal edge of the substrate.

16. The method of forming a protective coating according to claim 15, wherein the resin application is stopped while the projection nozzle is being moved downward toward the second longitudinal edge of the substrate.

17. A method of forming a protective resin coating for a head device which includes an insulating substrate having a first longitudinal edge and a second longitudinal edge opposite to the first longitudinal edge, an operating element arranged on the substrate adjacent to the first longitudinal edge, and an array of plural drive ICs mounted on the substrate and spaced from each other along the second longitudinal edge for actuating the operating element, the protective coating enclosing the drive ICs, the method comprising:

applying a fluid resin from a projection nozzle along an elongated spiral path for enclosing the drive ICs; and stopping the resin application at a position between a pair of adjacent drive ICs.

* * * * *